US005205336A

United States Patent [19]

Munekata et al.

[11] Patent Number: 5,205,336

[45] Date of Patent: Apr. 27, 1993

[54] ROLLING SHUTTER

[75] Inventors: Masaaki Munekata; Norihisa Isemura; Kazunobu Fukano, all of Tokyo, Japan

[73] Assignee: Sanwa Shutter Corporation, Tokyo, Japan

[21] Appl. No.: 880,672

[22] Filed: May 8, 1992

[30] Foreign Application Priority Data

Nov. 20, 1991 [JP] Japan ..... 3-331222

[51] Int. Cl.[5] ..... E06B 9/08

[52] U.S. Cl. ..... 160/133

[58] Field of Search ..... 160/133, 264, 23.1, 160/32

[56] References Cited

U.S. PATENT DOCUMENTS

| | | | |
|---|---|---|---|
| 1,437,205 | 11/1922 | Sheffield | 160/133 |
| 1,720,850 | 7/1929 | Negrini | 160/133 |
| 2,208,039 | 7/1940 | Mills | 160/133 |
| 2,349,702 | 5/1944 | Campion | 160/133 |
| 2,390,116 | 12/1945 | Michelman | 160/133 |
| 3,185,205 | 5/1965 | Caillet | 160/133 |
| 3,430,677 | 3/1969 | Pierce | 160/264 |
| 3,698,346 | 10/1972 | Bauer | 160/133 X |

*Primary Examiner*—David M. Purol
*Attorney, Agent, or Firm*—Ladas & Parry

[57] ABSTRACT

This invention relates to a rolling shutter having a shutter curtain being wound around a winding drum forming n-polygonal winding layers. According to this invention, since a sudden change of a diameter of winding layer is eliminated, the damage and deterioration of the slats are precluded efficiency of winding and unwinding operation is improved, and it becomes easier to put a manual-operated rolling shutter of this type to practical use.

The shutter curtain is comprised of slats being connected to each other and each winding layer is comprised of n slats which have the same vertical dimension. When the shutter curtain is being wound around the winding durm, the distance between the center of the winding drum and apexes of winding layers gradually increases by H/n. The distance H is the difference between a radius of a winding layer and that of adjacent winding layer(s).

4 Claims, 3 Drawing Sheets

ROLLING SHUTTER

FIELD OF THE INVENTION

This invention relates in general to a rolling shutter and more particularly to a rolling shutter comprising a shutter curtain wound around a winding drum to form substantially polygonal winding layers.

PRIOR ART STATEMENT

In the field of rolling shutters, a rolling shutter having a shutter curtain wound around a winding drum to form substantially polygonal winding layers, such as hexagonal shaped winding layers, is known.

For a shutter curtain of the prior art rolling shutter of this type, the following structure is known.

As is shown in FIG. 3, a shutter curtain 1, comprising slats pivotally connected to each other at parallel horizontal axes, is wound around a winding drum 2 to form hexagonal winding layers. For the purposes of discussion, the term "height" will refer to the shortest dimension of a face of a shutter, e.g. the vertical dimension of slat S2 in FIG. 3. The first five slats S1–S5 are made with the same height. The height of the sixth slat is longer than that of the preceding five slats S1–S5 and shorter than that of the succeeding five slats S11–S15.

Adjustment of the height of the last slat of each winding layer, e.g. slats S6, S16, permits the shutter curtain 1 to be wound around the winding drum 2 by offsetting a change in diameter of each winding layer.

However, the conventional shutter curtain has the disadvantages that, in making a shutter curtain which is wound around the winding drum to form m winding layers (m is the number of winding layers), two kinds of slats are required to form each winding layer, because a special height slat is required as the last slat of each winding layer, due to the fact that the last slat of each winding layer has to be longer in order to facilitate a change in the radius of the winding layer. This requirement makes assembly work extremely complicated and increases the final cost of the rolling shutters.

Further, a connecting piece, which joins together the long edges of adjacent slats, positioned at the forward edge of the last slat of each winding layer overlaps the connecting piece positioned at the rearward edge of the first slat of the same winding layer, and as a result, the winding moment increases abruptly due to a sudden change of the diameter of the winding layer. Thus, unnatural stress is generated at the aforementioned overlapping portion. The stress causes damage to the slat, accelerates deterioration of the slat, and inhibits easy winding and unwinding operations. Especially for a manually operated rolling shutter which counterbalances the shutter curtain using a coil spring, a sudden change of diameter of the winding layer upsets the balance, and operation sometimes stops while winding or unwinding the shutter curtain.

SUMMARY OF THE INVENTION

The present invention has been developed to eliminate the above-mentioned disadvantages of the prior art.

An object of this invention is to provide an improved rolling shutter having a shutter curtain wound around a winding drum to form n-sided polygonal winding layers without a sudden change of diameter of the winding layer, which prevents slats from being damaged, improves efficiency of winding and unwinding operation of a shutter curtain, and permits a manually operated rolling shutter to be practicable, where n is the number of slats in each winding layer.

Another object is to provide an improved rolling shutter having a shutter curtain comprised of fewer kinds of slats, which improves the efficiency of assembly work and reduces the final cost of the rolling shutters.

To accomplish the foregoing objects of this invention, there is provided a rolling shutter having the following structure.

A rolling shutter, constructed in accordance with the invention, comprises a shutter curtain wound around a winding drum to form n-sided generally polygonal shaped winding layers. The shutter curtain is comprised of n slats each of which have the same height. The height of the slats incrementally increases from one winding layer to a subsequent winding layer. When the shutter curtain is wound around the winding drum, the distance between the center of the winding drum and apexes of any one of the n-sided polygonal winding layers incrementally increases in the unwinding circumferential direction by H/n, where H is a radial distance between the winding layer and an adjacent winding layer at the apexes of the n-sided polygon.

DESCRIPTION OF THE PREFERRED EMBODIMENT

The present invention will now be described in conjunction with the preferred embodiment of the invention.

Figure 1:
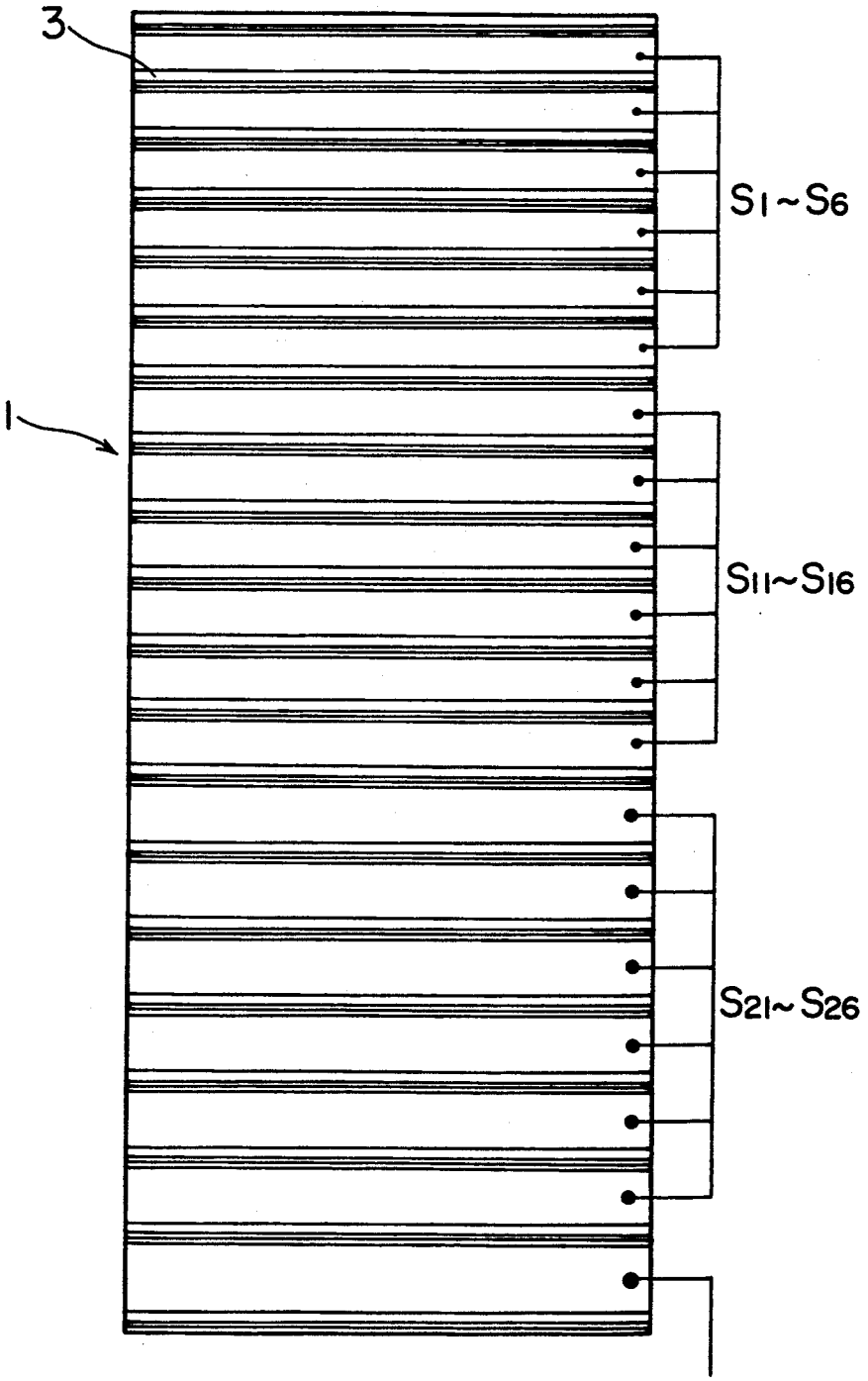
FIG. 1 is a front view of a shutter curtain comprising slats connected to each other at parallel horizontal axes.
Figure 2:
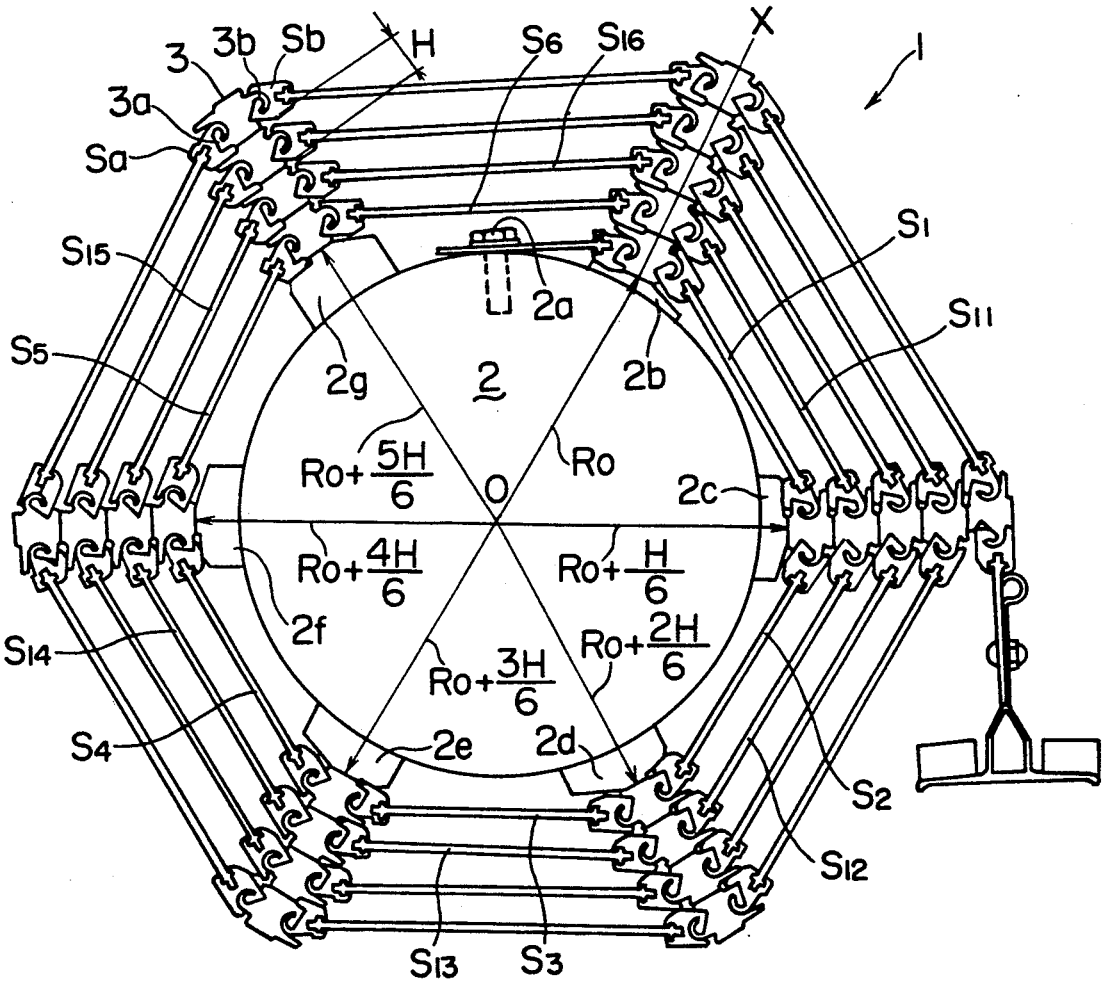
FIG. 2 is a side view of a winding drum with a shutter curtain wound to form winding layers.
Figure 3:
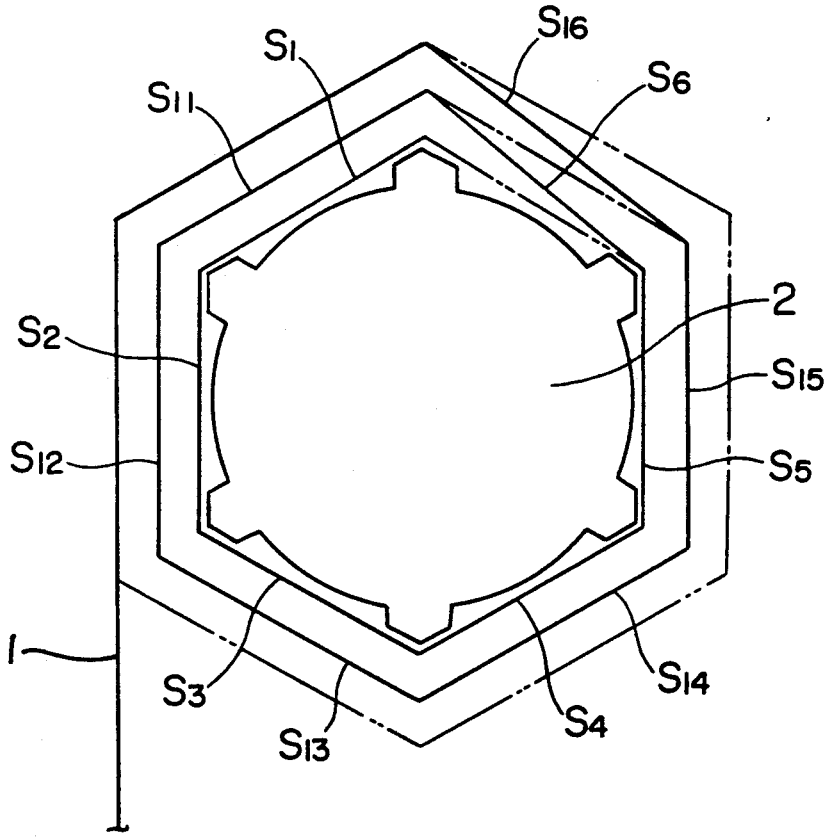
FIG.3 (PRIOR ART)
FIG. 3 is a side view of a conventional winding drum with a shutter curtain wound to form winding layers.

FIGS. 1 and 2 show the embodiment of the invention. In the drawings, reference numeral 1 denotes a shutter curtain of a rolling shutter which is comprised of several slats S pivotally connected to each other at parallel horizontal axes.

The shutter curtain 1 is wound around a winding drum 2 using the driving force of an electric motor (not shown) or being biased by a coil spring (not shown), like a conventional rolling shutter.

A joint piece 3 is provided between adjacent slats S. Receiving portions **3*a*, 3*b* are provided at the upper and the lower ends of the joint piece 3. For each joint piece 3, receiving portion 3*a* is pivotally interlocked to a mating connecting portion Sa provided at the lower end of the adjacent slat above joint piece 3, and the receiving portion 3*b* is pivotally interlocked to a mating connecting portion Sb provided at the upper end of the adjacent slat below joint piece 3**.

When the shutter curtain 1 is wound, the joint pieces 3 overlap with each other to prevent the slats S from contacting with each other.

The height of the slats S forming each winding layer differs so that the shutter curtain 1 is wound around the winding drum 2 to form layers of substantially hexagonal shape. As is shown in FIG. 2, the first winding layer is comprised of six slats S1–S6 all of which are formed to have the same height. The second winding layer is comprised of six slats S11–S16 all of which are formed to have the same height but which height is longer than that of the preceding slats S1–S6. The height of the slats S increases every six slats in accordance with an increase of the diameter of the winding layers, so that each winding layer is comprised of six slats all formed to have the same height, and no transition slat is required.

A hanging base 2a interlocking the shutter curtain 1 to the winding drum 2 and convex portions 2b–2g supporting each joint piece 3 of the first winding layer are provided on the outer surface of the winding drum 2.

The convex portions 2b–2g are provided to project radially from the outer surface of the winding drum 2 and are angularly spaced at a constant interval. The radial dimensions of the convex portions 2b–2g incrementally increases by H/n in the unwinding circumferential direction.

The distance H is the radial distance between one winding layer and an adjacent winding layer at the location of the joint pieces 3, and is equal to the thickness of the joint pieces 3.

The distance between the center 0 of the winding drum 2 and apexes of the generally hexagonal winding layers incrementally increases by H/n (i.e., Ro, Ro+H/n, Ro+2H/n, . . . ), so that a sudden change of diameter is eliminated. Thus, it is not necessary to make the last slat of each winding layer have a special height to offset a sudden change of diameter to the next winding layer.

According to the preferred embodiment of this invention, the rolling shutter comprises the shutter curtain 1 and the winding drum 2. The shutter curtain I is comprised of slats S whose height increases every six slats. The convex portions 2b–2g are provided on the outer surface of the winding drum 2, and the radial location of their joint piece receiving surfaces incrementally increases by H/6 in the unwinding circumferential direction, such that when the shutter curtain 1 is wound around the winding drum 2, the joint pieces 3 overlap each other at axes X inclined to radial axes which pass through the center 0 of the winding drum 2 and apexes of the generally hexagonal shape formed by the slats.

Since the radial dimension of the convex portions 2b–2g incrementally increases by H/6, a sudden change of diameter of the winding layers can be eliminated, and each winding layer is comprised of slats which have the same height. Thus, in winding the shutter curtain around the winding drum to form m winding layers, only m kinds of slats are required for the shutter curtain, where m is any whole number.

Further, since a sudden change of winding layer diameter is eliminated, unnatural stress is precluded at the overlapping portion of the connecting joint positioned forward of the last slat (e.g. S6) of a winding layer and the connecting joint positioned rearward of the first slat (e.g. S1) of the same winding layer.

Still further, since it thus becomes easier to counterbalance the shutter curtain 1, efficiency of winding and unwinding operations is improved.

As will be understood from the foregoing description, the present invention offers the following advantages.

(1) Since only m kinds of slats are required for the shutter curtain wound around the winding drum to form m n-sided polygonal winding layers, fewer kinds of slats are required, the assembly work is simplified and the cost is greatly reduced.

(2) Since a sudden change of diameter of each winding layer is eliminated, unnatural stress is not generated, so that damage and deterioration of the slats are precluded.

(3) Since a winding moment can be balanced, efficiency of winding and unwinding operations of the shutter curtain is improved and it becomes easier to counterbalance the shutter curtain using a coil spring.

What is claimed is:

1. A rolling shutter comprising a shutter curtain wound around a winding drum and forming multiple winding layers, each layer approximating a polygon having n sides, where n is a whole number, and wherein:

said shutter curtain comprises a plurality of slats pivotally connected to each other at parallel horizontal axes;

each winding layer comprises n slats each of which have the same height dimension, the height dimension incrementally increasing from those in one winding layer to those in the next adjacent outer winding layer; and said rolling shutter further comprises a plurality of shutter curtain receiving surfaces spaced about the periphery of the winding drum adjacent the apexes of the first polygonal shaped winding layer, each said curtain receiving surface being spaced a different distance from the center of the winding drum, such that, when said shutter curtain is wound around said winding drum, the distance between the center of said winding drum and adjacent apexes of said n-sided polygon, in the direction of winding of said shutter curtain about the winding drum, incrementally increases by H/n, where H is the difference between a radius of a winding layer and that of an adjacent winding layer at each apex.

2. A rolling shutter as claimed in claim 1, wherein said shutter curtain is wound around a circular shaped winding drum.

3. A rolling shutter comprising:

a winding drum;

a shutter curtain for winding around said winding drum to form polygonal winding layers, said shutter curtain comprising a plurality of slats pivotally connected to each other at parallel longitudinal axes, each winding layer comprising n slats each of which have the same height dimension, the height dimension incrementally increasing from those in one winding layer to those in the next adjacent outer winding layer; and a plurality of convex members equally spaced about the periphery of said winding drum to support the apexes of the first polygonal shaped winding layer, each said convex member having a curtain receiving surface spaced a different distance from the center of the winding drum, the distance between the center of said winding drum and adjacent apexes of said n-sided polygon, in the direction of winding of said shutter curtain about the winding drum, incrementally increasing by H/n, where H is the difference between a radius of a winding layer and that of an adjacent winding layer at each apex, and n is the number of slats of each winding layer.

4. A rolling shutter as claimed in claim 3, wherein the winding drum is circular shaped.

* * * * *